United States Patent [19]

Ruchser et al.

[11] 4,345,620

[45] Aug. 24, 1982

[54] SAFETY VALVE ASSEMBLY

[75] Inventors: Erich Ruchser, Kernen; Helmut Ott, Stuttgart; Günter Baldauf, Rommelshausen, all of Fed. Rep. of Germany

[73] Assignee: Technomatic AG, Aesch, Switzerland

[21] Appl. No.: 169,933

[22] Filed: Jul. 17, 1980

[30] Foreign Application Priority Data

Jul. 27, 1979 [DE] Fed. Rep. of Germany ..... 2930571

[51] Int. Cl.[3] ..... F15B 13/043; F15B 20/00

[52] U.S. Cl. ..... 137/596.16; 91/424; 91/448; 137/596.18

[58] Field of Search ..... 91/424, 448; 137/596.14, 596.16, 596.18

[56] References Cited

U.S. PATENT DOCUMENTS 4,269,225 5/1981 Ruchser et al. ..... 137/596.16

4,291,613 9/1981 Porter ..... 92/5 R X

FOREIGN PATENT DOCUMENTS 1294747 11/1972 United Kingdom ..... 137/596.16

*Primary Examiner*—Gerald A. Michalsky

*Attorney, Agent, or Firm*—Michael J. Striker

[57] ABSTRACT

A safety valve assembly for pressurized medium-operated devices has a housing with a supply inlet, a consumer outlet, and a return outlet, two valves operating in parallel with one another, and each having a working piston and a valve member guided in chambers of the housing and operative for establishing and interrupting the communication between the inlet and outlets via two cross-passages wherein a pressure sensing element is provided having two opposite sides each communicating with a respective one of the cross-passages and displaceable in the event of malfunctions from its inoperative to its operative position so as to act in the latter position upon an actuating member arranged to turn off a consumer in response to the displacement of the pressure sensing element to its operative position.

9 Claims, 3 Drawing Figures

SAFETY VALVE ASSEMBLY

BACKGROUND OF THE INVENTION

The present invention relates to a safety valve assembly for pressure medium-operated consumer devices, particularly clutch and brake devices for presses. More particularly, it relates to a safety valve assembly which has two valves operating in parallel with one another and each having a working piston and a valve member, the valve members correspondingly controlling the connections between a supply inlet, a consumer outlet and a return outlet provided in the housing of the assembly.

Safety valve assemblies of the above-mentioned general type are known in the art. In a known safety valve assembly disclosed in the German application Ser. No. 2,756,240.9, the valve members are guided in chambers of the housing which communicate with one another by cross-passages, wherein each of the cross-passages extends from the supply side of one chamber to the discharge side of the other chamber to the point located upstream of a respective one of the valve seats of the valves. In the above-mentioned safety valve assembly, no residual pressure takes place in the consumer outlet in the event of malfunction of one of the valves. In order to monitor the position of the valve, a pressure switch is provided which compares the pressure in the cross-passages with the supply pressure and actuates a respective electric switch in the event of deviation of pressure in the passages. The electric switch, in turn, turns off the entire assembly. The monitoring which is performed in this safety valve assembly is relatively complicated, to some extent.

SUMMARY OF THE INVENTION

Accordingly, it is an object of the present invention to provide a safety valve assembly which avoids the disadvantages of the prior art.

More particularly, it is an object of the present invention to provide a safety valve assembly which allows simpler monitoring of the position of valves of the assembly.

In keeping with these objects and with others which will become apparent hereinafter, one feature of the present invention resides, briefly stated, in a safety valve assembly in which pressure sensing means is provided which has two opposite sides each communicating with a respective one of the cross-passages, so that in the event of malfunction the pressure sensing means is displaced from its inoperative or neutral position to its operative position, whereby the thus-displaced pressure sensing means acts upon actuating means which turns off the consumer or the entire assembly.

The pressure sensing means may include a pressure sensing element having two opposite sides each communicating with a respective one of the cross-passages, so that when the pressures in the cross-passages and thereby at both sides of the pressure sensing element are identical, the pressure sensing element remains in its neutral position. On the other hand, when the pressure in one of the cross-passages and thereby at one side of the pressure sensing element is greater than the pressure in the other passage and at the other side of the pressure sensing element, the pressure sensing element displaces from its neutral position to its operative position and thereby acts upon the actuating means to turn off the consumer.

When the safety valve assembly is designed in accordance with the applicants' invention, the monitoring of the valves is simpler than that in the known safety valve assemblies.

In accordance with a further advantageous feature of the present invention, the pressure sensing element includes two identical stepped pistons which are located at axially opposite sides of an axially displaceable sliding member. The stepped pistons communicate with the cross-passages and in the event of the pressure differential provide for the axial displacement of the sliding member from its neutral position to its operative position. The sliding member is arranged to act upon an electric switch when the former is displaced from its neutral position to its operative position.

In accordance with a further advantageous feature of the present invention, each stepped piston has a portion of a greater diameter which is guided in a respective chamber of the housing and moves toward the sliding member until it abuts against an abutment in the housing. Each of the stepped pistons has also a portion of a smaller diameter which always engages in a blind hole of the sliding member. The sliding member is axially displaceable relative to the stepped pistons.

In accordance with still a further feature of the present invention, the diameter of the first-mentioned portion of each stepped piston is substantially twice as great as the diameter of the second-mentioned portion of the same piston.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
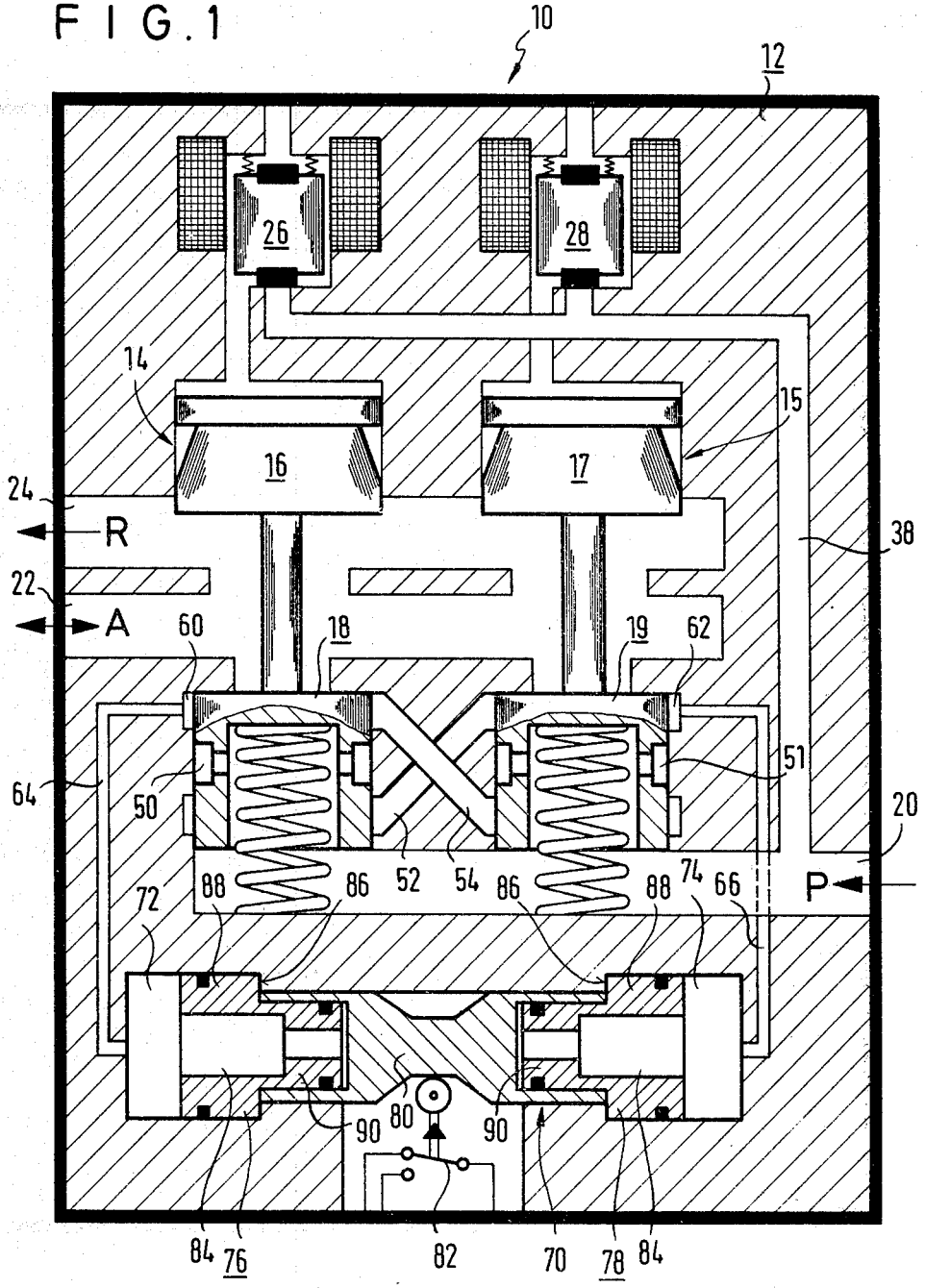
FIG. 1 is a view showing a section of a safety valve assembly in a neutral or inoperative position.

FIG. 1 depicts a safety valve assembly 10, for example a safety valve assembly for a press. The valve assembly has a housing 12, and two valves 14 and 15 which are located in the housing parallel to one another and movable in the direction of their axes. Each of the valves 14 and 15 has a working piston 16 or 17 and a valve member 18 or 19 connected with a respective one of the working pistons.

The housing 12 is provided with a supply inlet 20 for supplying a pressurized medium, for example compressed air, a consumer outlet 22 which is connected, for example, to a clutch and brake of a press, and a return outlet 24 which is vented, for example, to the atmosphere.

The valves 14 and 15 are actuated, for example, by electromagnetically operated servo valves 26 and 28 which communicate via a passage 38 with the supply inlet 20.

The pressure medium acts from the supply inlet 20 via the conduit 38 and the control valve 26 and 28, upon the working pistons 16 and 17. Thereby, the valve members 18 and 19 move from their inoperative position shown in FIG. 1 to the operative position shown in FIG. 2 and vice versa.

Figure 2:
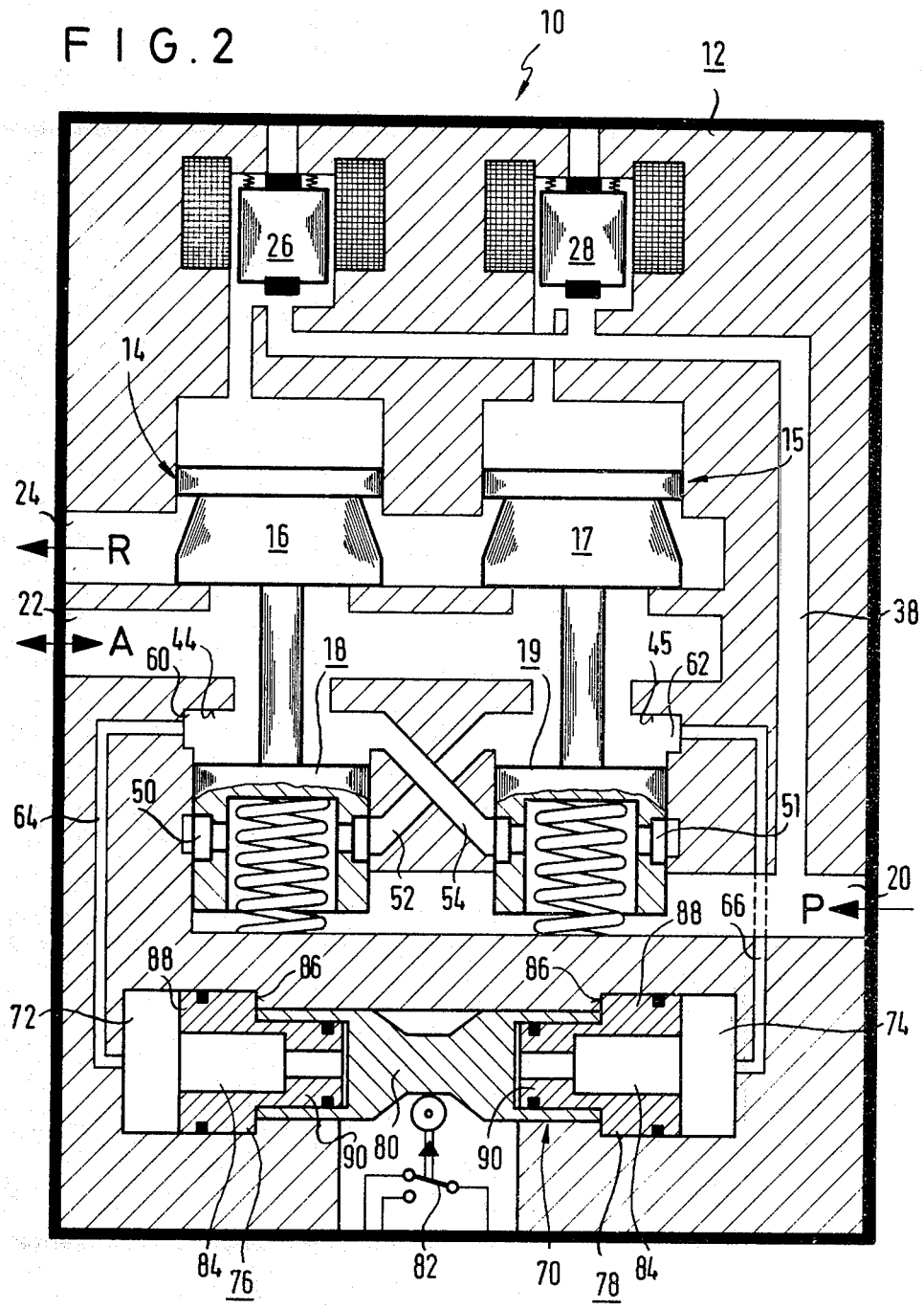
FIG. 2 is a view corresponding to that of FIG. 1 but showing the inventive safety valve assembly in an operative position.

The valve members 18 and 19 cooperate with valve seats 44 and 45 (as shown, for example in FIG. 2). Thereby, the communication between the supply inlet 20 and the consumer outlet 22 can be established or interrupted in dependence upon the respective positions of the valve members.

Each valve member 18 and 19 is formed as a piston which is guided in a chamber of the housing 12. Each piston-shaped valve member 18 and 19 is urged to its closed position by a pressure spring. Normally, each valve member 18 and 19 has a central axial recess, an annular passage 50 or 51 provided on the cylindrical surface of the valve member, and a transverse hole communicating the recess of each of the valve members with the annular passage 50 or 51 of the same valve member. The annular passages 50 and 51 always communicate with the supply inlet 20 via the central recesses and the transverse bores. Thereby, the pressurized medium flows from the supply inlet 20 directly into the annular passages 50 and 51.

The chambers in which the valve members 18 and 19 are guided, are connected with one another by two crosswise extending connecting passages 52 and 54. The connecting passage 52 extends from an inlet side of the left chamber to an outlet side of the right chamber, as considered in the drawing. The connecting passage 54 extends from an inlet side of the right chamber to the outlet side of the left chamber. The passages 52 and 54 cross each other, as mentioned above, but do not communicate with each other. Each of the cross passages 52 and 54, is open in a respective one of the chambers at a point located upstream of a respective one of the valve seats 44 and 45.

FIG. 1 shows both valves in neutral or inoperative position. In this position the valve seats 44 and 45 are closed, so that no pressurized medium can flow from the supply inlet 20 to the consumer A. In FIG. 2, the operative position of the safety valve assembly is shown. In the latter-mentioned position, the valve seats 44 and 45 are open, and the pressurized medium flows from the supply inlet 20 to the annular passage 51 of the valve member 19 and then via the connecting passage 54 and the open valve seat 44 to the consumer outlet 22. Simultaneously, the pressurized medium flows from supply inlet 20 to the annular passage 50 of the valve member 18 and then via the connecting passage 52 and the open valve seat 44 also to the consumer outlet 22. The communication with the return outlet 24 in the position shown in FIG. 2 is interrupted by the working pistons 16 and 17, whereas in the position shown in FIG. 1 the consumer outlet 22 and the return outlet 24 communicate with each other.

Figure 3:
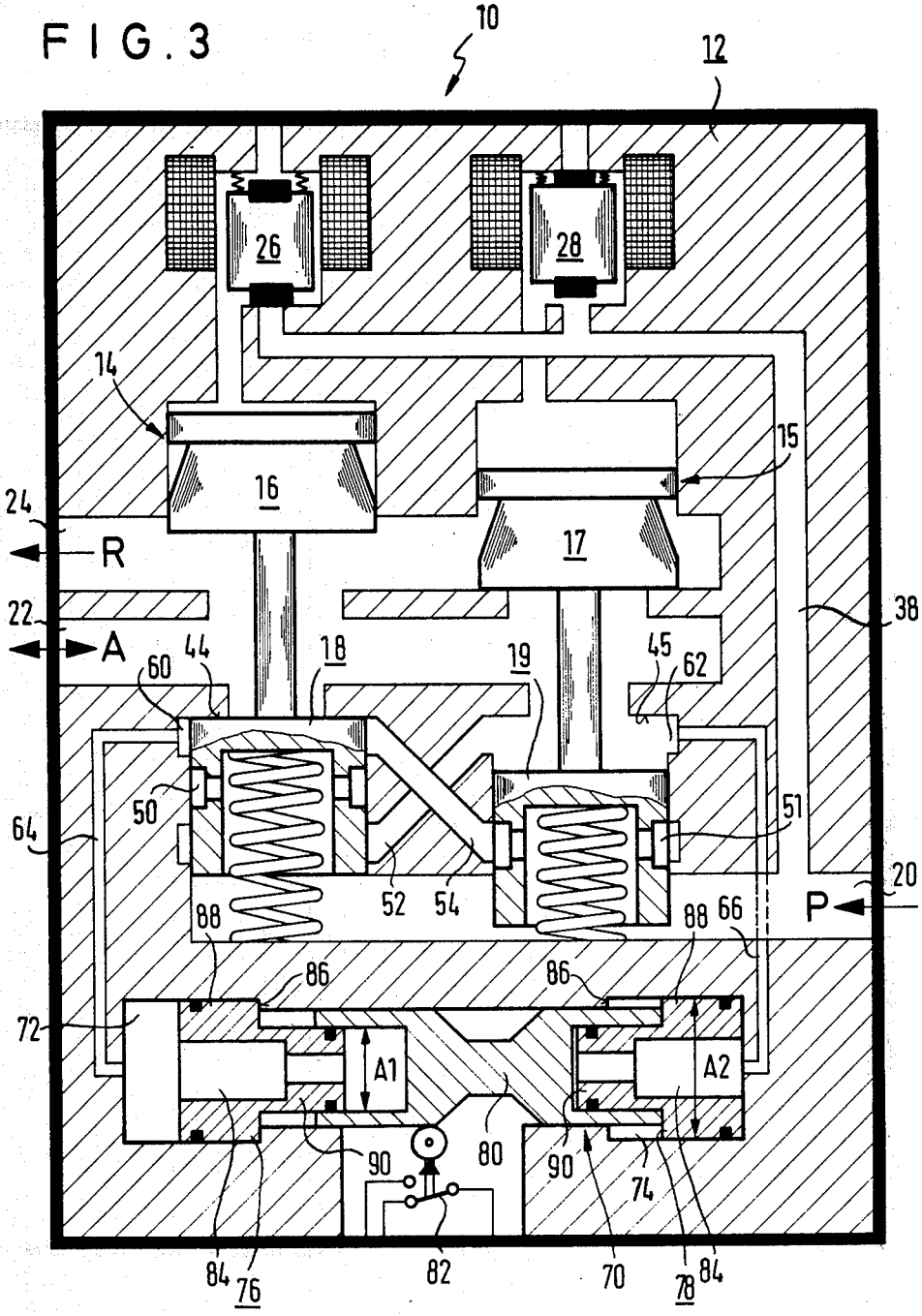
FIG. 3 is a view corresponding to that shown in FIG. 1 but showing the inventive safety valve assembly in the event of malfunction.

FIG. 3 shows the safety valve assembly in the event of malfunction when the valve seat 44 is closed, whereas the valve seat 45 is open. The pressurized medium 20 flows to the annular passage 51 of the valve member 19 and then into the connecting passage 54. However, it cannot flow further as much as the valve seat 44 is closed. The pressurized medium also flows from the supply inlet 20 in the central recess of the valve member 18, but cannot flow out of the same into the connecting passage 52 inasmuch as the latter is blocked by the valve member 18 (closed by the outer surface of the valve member 18). Thereby no pressurized medium can flow from the supply inlet 20 to the consumer outlet 22. The consumer outlet 22 is vented through the open valve seat of the working piston 16 to the return outlet 24.

The safety valve assembly is provided with a pressure sensing member or a pressure balancing member 70 shown in the drawing and arranged in the housing 12. The pressure sensing member 70 is composed of two identical stepped pistons 76 and 78 and a sliding member 80 located at a common axis. The stepped pistons 76 and 78 are arranged at opposite axial sides of the sliding member 80 and face toward one another.

Each of the stepped pistons 76 and 78 have a portion 88 of a greater diameter which is movably arranged and guided in a respective one of working chambers 72 and 74. Each of the stepped pistons further has a portion 90 of a smaller diameter which engages in a blind hole of the sliding member 80 and is movably guided in the axial direction. Suitable sealing members, for example, O-rings are provided between the portions 88 of the greater diameter and the walls of the working chambers 72 and 74, as well as between the portions 90 of smaller diameter and the walls of the blind holes of the sliding member 80. Both stepped pistons 76 and 78 are provided with a central longitudinal passage 84 which extends completely through each of the pistons.

The sliding member 80 is provided, in the region of its central portion, with a neck having inclined starting edges at its both sides. An electric switch 82 cooperates with the neck with the inclined starting edges via, for example, a respective roller. This cooperation provides for turning off the consumer or the control means of the consumer in the event of malfunction.

The working chambers 72 and 74 communicate with the connecting passages 54 and 52 via conduits 64 and 66. The connecting passages 54 and 52 are open in annular passages 60 and 62 formed in the housing 12 and extending about the periphery of the valve members 18 and 19. The annular passages 60 and 62 are connected by the above-mentioned conduits 64 and 66 with the working chambers 72 and 74.

The safety valve assembly in accordance with the present invention operates in the following manner:

In the inoperative position shown in FIG. 1, the working pressure P in the supply inlet 20 is built in both working chambers 72 and 74 via the piston play between the piston-shaped valve members 18 and 19, and the chambers in the housing, in which the valve members are guided. The pressurized medium leaks via the piston plate out of the annular passages 50 and 51 into the annular passages 60 and 62 and then via the conduits 64 and 66 into the working chambers 72 and 74. Both stepped pistons 76 and 78 are subjected to the pressure P and abut by their shoulders on respective abutments 86 formed in the housing 12, whereby the sliding member 80 remains in its central position.

In the operative position shown in FIG. 2, both valve seats 44 and 45 are opened, and both working chambers 72 and 74 of the balancing member communicate via the conduits 64 and 66 with the valve seats 44 and 45 wherein or whereon the identical pressures act. Thereby, the identical pressures also act in the working chambers 72 and 74, so that the balancing member does not displace and remains in its central position.

In the event of malfunction shown in FIG. 3, the full supply pressure is built in the working chamber 72 via the supply inlet 20, the annular passage 51, the connecting passage 54, the annular passage 60 and the conduit 64. As for the working chamber 74, the latter is vented via the conduit 66, the open valve seat 45, and the open valve seat of the working piston 16, to the return outlet 24.

The pressurized medium in the working chamber 72 is thereby under the supply pressure, whereas the pressurized medium in the working chamber 74 is only under the atmospheric pressure. The piston 76 remains in its position in which it abuts against the abutment 86 whereas the piston 78 is displaced by the slider 80 to the right until it abuts against the right end wall of the working chamber 74.

Because of this displacement, the pressurized medium flows from the working chamber 72 via the longitudinal passage 84 of the piston 76 into the left blind hole of the sliding member 80, as considered in FIG. 3. Thereby, the full supply pressure P is applied to the sliding member 80 and the latter displaces to the right, as shown in FIG. 3. During this displacement, the sliding member 80 acts upon the electric switch 82 so that it is turned from the position shown in FIGS. 1 and 2 to the position shown in FIG. 3. This turning of the switch 82 is utilized, for example, to turn off the entire assembly, the control valve 26 and 28, or the control means of the consumer.

When the malfunction is eliminated, the working chamber 74 is again supplied with the pressurized medium under the supply pressure P, whereby the piston 78 displaces to the left in FIG. 3 until it abuts against the abutment 86. As a result of this, the balancing member is displaced to its neutral central position.

The ratio between the working face area of the portion 88 of the greater diameter and the working face area of the portion 90 having the smaller diameter, of each of the stepped pistons, may be equal, for example, to 2:1. The working faces are here the end faces whose diameter corresponds to the outer diameter of the portions 88 or 90.

When the safety valve assembly is provided with the pressure sensing or pressure balancing member in accordance with the present invention, great adjusting force is generated in the event of malfunction, inasmuch as the full operating pressure acts upon the piston face A1 (FIG. 3) whereas the piston face A2 (FIG. 3) is subjected only to the atmospheric pressure.

The sensitivity of response of the pressure sensing member can be adjusted as desired and particularly kept very small by respective selection of the working faces of the stepped pistons, for example, with the ratio 2:1, and by the great volumes of the working chambers 72 and 74 and the narrow passages 64 and 66.

Conventional centering springs associated with the pressure sensing members of the known constructions are dispensed with in the inventive safety valve assembly. In this situation, the pressure sensing member must not displace against a spring force in the event of malfunction. Moreover, in the inoperative position, in exact central location of the pressure sensing member is always guaranteed, which is not always the case in the constructions which utilize the springs because of the friction in the regions of the sealing elements.

The illustrated pressure sensing member and the measurements of pressure in the annular passages 60 and 62 may be utilized for monitoring leakage of the valve seats 44 and 45.

When, for example, in the inoperative position of FIG. 1 a leakage in the valve seat of the valve member 18 is greater than that because of the piston play between the piston-shaped valve member and the housing, then, the pressurized medium will flow out of the working chamber 72. Thereby, the pressure will be built in the working chamber 72 and the pressure sensing member will move to its malfunction position in which it will actuate the switch 82 as described above.

It will be understood that each of the elements described above, or two or more together, may also find a useful application in other types of constructions differing from the types described above.

While the invention has been illustrated and described as embodied in a safety valve assembly, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A safety valve assembly for pressurized medium-operated devices, particularly clutch and brake devices of presses, comprising a housing having a supply inlet, a consumer outlet and a return outlet, said housing also having two separate chambers and two passages which crosswise connect said chambers with one another; two valves operating in parallel with one another and each having a working piston and a valve member, said valve members of said valves being guided in said chambers of said housing and operative for establishing and interrupting the communication between said inlet and outlets via said cross-passages so as to allow passage of a pressurized medium or to prevent the same; means for controlling the operation of said valves; pressure-sensing means having two opposite sides each communicating with a respective one of said cross-passages and displaceable in the event of malfunction from its inoperative position to its operative position; and actuating means arranged to turn off a consumer in response to the displacement of said pressure-sensing means from its inoperative position to its operative position, said pressure-sensing means including a pressure balance having two sides each communicating with a respective one of said cross-passages so that when the pressure in said cross-passages and thereby at both sides of said pressure balance are identical said pressure balance remains immovable and is retained in its inoperative position, and when in the event of malfunction of pressure in one of said cross-passages and thereby at one of said sides of said pressure balance is greater than the pressure in the other of said cross-passages and thereby at the other of said sides of said pressure balance, said pressure balance is displaced from its inoperative position to its operative position, said pressure balance including a sliding member having an axis and movable in an axial direction between said inoperative and operative positions, and two stepped pistons located at axially opposite sides of said sliding member and each communicating with a respective one of said cross-passages, said stepped pistons being arranged so as to retain said sliding member in said inoperative position and to displace the same to said operative position in dependence upon the relation between the pressures of the pressurized medium in said cross-passages.

2. A safety valve assembly as defined in claim 1, wherein said controlling means is electromagnetic means.

3. A safety valve assembly as defined in claim 1, wherein each of said chambers has a supply side and a discharge side, each of said cross-passages extending from the supply side of one of said chambers to the discharge side of the other of said chambers.

4. A safety valve assembly as defined in claim 3, wherein said housing has a valve seat for each of said valve members, each of said cross-passages extending to a point located upstream of a respective one of said valve seats.

5. A safety valve assembly as defined in claim 1, wherein said sliding member is arranged to cooperate with said actuating means so that when said sliding member displaces to said operative position, said actuating means turn off the consumer.

6. A safety valve assembly as defined in claim 5, wherein said actuating means includes an electric switch cooperating with said sliding member.

7. A safety valve assembly as defined in claim 6, wherein each of said pistons has a through-going axial opening.

8. A safety valve assembly as defined in claim 1, wherein said sliding member is axially movable relative to said stepped pistons and has two axially opposite sides each provided with a blind hole, said housing having two further chambers and two abutments arranged at the opposite axial sides of said sliding member, each of said stepped pistons having a portion of a greater diameter which is guided in a respective one of said further chamber and axially movable in direction toward said sliding element until it abuts against a respective one of said abutments, each of said stepped pistons further having a portion of a smaller diameter which always engages in a respective one of said blind holes of said sliding element.

9. A safety valve assembly as defined in claim 8, wherein the portion of greater diameter of each of said stepped pistons has a working face which is substantially twice as great as that of the portion of smaller diameter of the same stepped piston.

* * * * *